United States Patent [19]

Kuhl

[11] 4,064,635

[45] Dec. 27, 1977

[54] APPARATUS FOR DRYING PLASTIC TRAYS

[76] Inventor: Henry Y. Kuhl, Kuhl Road, Flemington, N.J. 08822

[21] Appl. No.: 696,974

[22] Filed: June 17, 1976

[51] Int. Cl.[2] ..... F26B 17/30

[52] U.S. Cl. ..... 34/58; 198/414; 242/155 M; 34/103; 214/310; 118/54

[58] Field of Search ..... 34/58, 59, 8, 184, 103, 34/104; 214/1 BH, 309, 1 BT, 310; 198/414, 373; 134/117, 149; 118/52, 54, 56; 261/83; 242/155 M

[56] References Cited

U.S. PATENT DOCUMENTS

| | | | |
|---|---|---|---|
| 2,937,553 | 5/1960 | Sherman | 198/414 |
| 3,113,746 | 12/1963 | Steen | 242/155 M |
| 3,295,660 | 1/1967 | Nelson | 198/414 |
| 3,812,599 | 5/1974 | Bruckner | 34/155 |
| 3,861,061 | 1/1975 | Ross | 34/103 |
| 3,870,014 | 3/1975 | Buck | 118/501 |

FOREIGN PATENT DOCUMENTS

| | | | |
|---|---|---|---|
| 756,335 | 9/1956 | United Kingdom | 242/155 M |

*Primary Examiner*—John J. Camby
*Assistant Examiner*—Henry C. Yuen
*Attorney, Agent, or Firm*—Albert Sperry; Frederick A. Zoda; John J. Kane

[57] ABSTRACT

Equipment for use in washing articles such as egg trays and the like wherein the articles after being washed are moved by a conveyor to a drying zone for being picked up by a rotatable carriage by which they are lifted into a hood and rotated at high speed to discharge water or other washing liquid therefrom. The movement of the conveyor and the rotation of the carriage are coordinated to start and stop the rotation of the carriage so as to dry one article after another as it is advanced to the drying zone and onto the carriage by the conveyor. The rotatable carriage includes a system for orientation of the trays or the like for discharge to the conveyor and a brake assembly for quickly decreasing the rotational velocity of the carriage.

8 Claims, 3 Drawing Figures

APPARATUS FOR DRYING PLASTIC TRAYS

BACKGROUND OF THE INVENTION

Egg trays and incubator trays as well as trays used in the baking industry and elsewhere are generally formed of metallic or plastic materials. In order to recycle such trays and maintain them in a clean sanitary condition, they must be washed from time to time. However, most plastic and metallic materials are hydrophobic with the result that washing liquids tend to cling to the articles in the form of droplets instead of spreading out in a thin film for ready evaporation. It is therefore particularly difficult to dry plastic or metallic trays after washing and the duration of any conventional drying operation employed is materially prolonged. As a result, the drying step in the conveyor system unduly delays the unit cycle time of the entire system.

It is, of course, common practice to remove water from clothing, liquid slurries and other materials by centrifuging operations using a perforated drum into which the material to be dried is charged as exemplified by U.S. Pat. Nos. 930,898 and 3,300,871. However, such equipment is not adapted for use in drying plastic or metal trays or containers. In particular such equipment is not capable of use with a conveyor for supplying and removing articles to be dried.

Previous methods of drying these trays include a high speed blower for exposing the trays to hot air, but this system was quite time consuming and required a considerable output of energy to both heat the air and run the blower. The present invention therefore accomplishes not only a shortening of the drying cycle time but also substantially decreases energy consumption.

SUMMARY OF THE INVENTION

The present invention may be used with a conveyor or other similar transporting device which is adapted to carry an egg tray or other tray-like receptable into a drying zone. Positioned below the empty wet tray in the drying zone, is a carriage assembly which has a tray support member in the upper portion thereof. The tray support member is adapted to contact the undersurface of a tray by studs or the like protruding therefrom such that when the entire carriage assembly is moved upward, the stud members protrude into the indentations in the irregularly shaped undersurface of the egg trays. The bottom surface of most standard egg trays are usually structured with irregular protrusions and indentations such that the stud members can be chosen in an orientation to mate therewith or, in the alternative, special trays can be chosen to facilitate use with a chosen configuration of studs.

The support member is rotatably mounted within a body such that when the body is moved upwardly, the studs in the tray support me ber contact the wet trays and lift them out of the drying zone and up into a hood which is positioned immediately above the drying zone. Once the wet tray is in the hood, the support member is rotated at a speed sufficient to expell any liquid from the tray and fling it outward against the inside surface of the hood. After the rotated member stops, the body is then moved downwardly and the tray is replaced in the drying zone and carried away by the conveyor.

The support is mounted upon a shaft which is rotatably mounted in the body and is secured at the lower end thereof to the rotational control means. The rotational control means causes rotation of the shaft, the support and the tray whenever the body is in the up position and additionally provides a braking force to reduce the speed of rotation of the support member to bring it quickly to a predetermined position. The rotational control means preferably includes an orientation means for assuring replacement of the tray into the spin station in identical rotational position every time. To accomplish these varied functions, the rotational control means preferably is an electromagnetic structure.

A vertical moving means such as a pneumatic cylinder or the like can be mounted to the body to cause vertical movement of the support and tray. When used within a total conveyor system, the actuation of the vertical movement means will be synchronized with the washer or other conveyor assembly upstream in the system from the drying station and with a stacking station downstream from the drying station.

BRIEF DESCRIPTION OF THE DRAWINGS

While the inventon is particularly pointed out and distinctly claimed in the concluding portions herein, a preferred embodiment is set forth in the following detailed description which may be best understood when read in connection with the accompanying drawing, in which:

DETAILED DESCRIPTION OF THE PREFERRED EMBODIMENT

Figure 1:
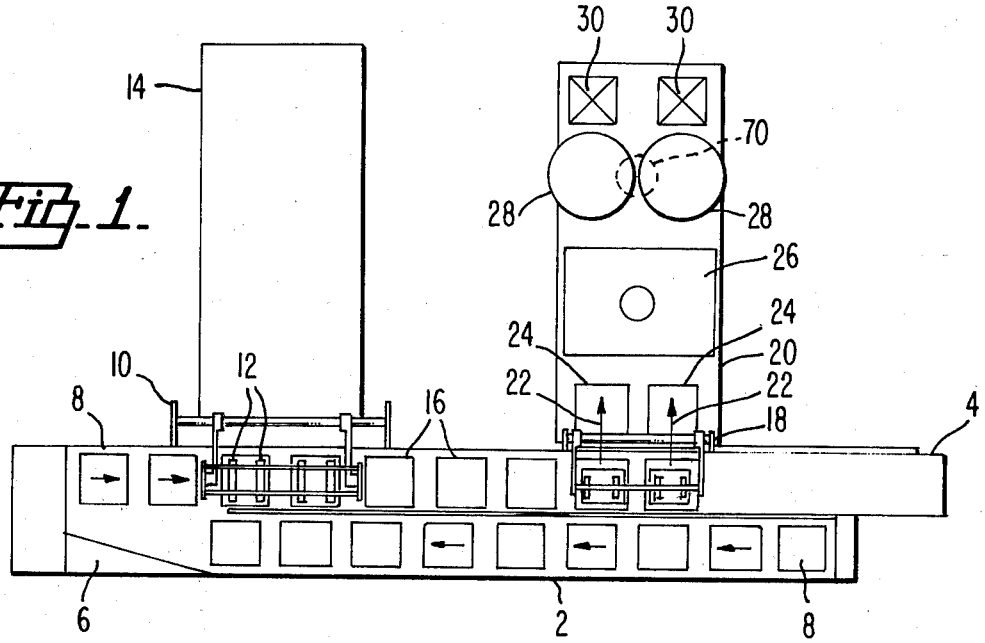
FIG. 1 is a plan view of a preferred embodiment of the present invention as used with an entire conveying system.

The present invention comprises an apparatus and process for drying plastic or metallic trays which can be used in association with or without a conveying system such as an egg conveying system as shown in FIG. 1. A pair of oppositely traveling conveyors 2 and 4 are connected by a reversing ramp 6 such that the egg trays 8 which may have dirty eggs deposited therein are carried by conveyor 2 to ramp 6 and then urged onto oppositely moving conveyor 4. The eggs are dirty since they pass directly from the chicken houses to the trays and are often covered with feathers, blood and chicken waste. These trays and eggs proceed to egg removal station 10 where the suction elements 12 lift the eggs from the trays 8 and place them on egg collecting conveyor 14 for further processing such as washing etc. The empty and dirty trays 16 are thereafter carried by conveyor 4 to tray removal station or transfer ramp 18 where the trays are moved onto conveyor 20 in the direction shown by arrows 22.

The trays 24 proceed to wash station 26 which can be adapted to accept two rows of dirty trays 24 as shown in FIG. 1. Any convenient washing method can be utilized at a washing station 26 such as a standard spraying system using high pressure washing liquid and soaps. After washing, the wet trays travel to spin drying station 28 and thereafter to stacker 30. Preferably the movement of transfer conveying, spin drying, stacking and washing are synchronously operated to achieve a rapid and effective total overall system.

Within the spin station 28 is a tray receiving area or chute area generally designated as 32. The empty egg tray 34 is carried by conveyor 20 from the washing station 26 and placed in the tray receiving area 32 while still wet. Since plastic materials resist air drying due to the hydrophobic nature of its surface, a spin drying apparatus is utilized which expells the water by centrifugal force. When properly located in the area 32 the tray 34 is positioned directly above the carriage assembly which comprises a rotatable support member 36 and a body section 38. When moved upwardly the support 36 is adapted with studs 37 to lift plastic trays 34 out of the tray receiving area and up into the hood 40. It should be appreciated that similar mechanical expedients can be utilized to drop the tray into a lower hood rather than lift the tray up into a hood. The support 36 and therefor the tray 34 are then rotated at a speed sufficient to expell any droplets of washing or rinsing solution which remain on the surface of the tray 34. Since all spinning is conducted within the hood 40, all water circumferentially sprayed from the support and the tray is collected by the interior surface of the cylindrical hood and drains therefrom as a waste material.

Figure 3:
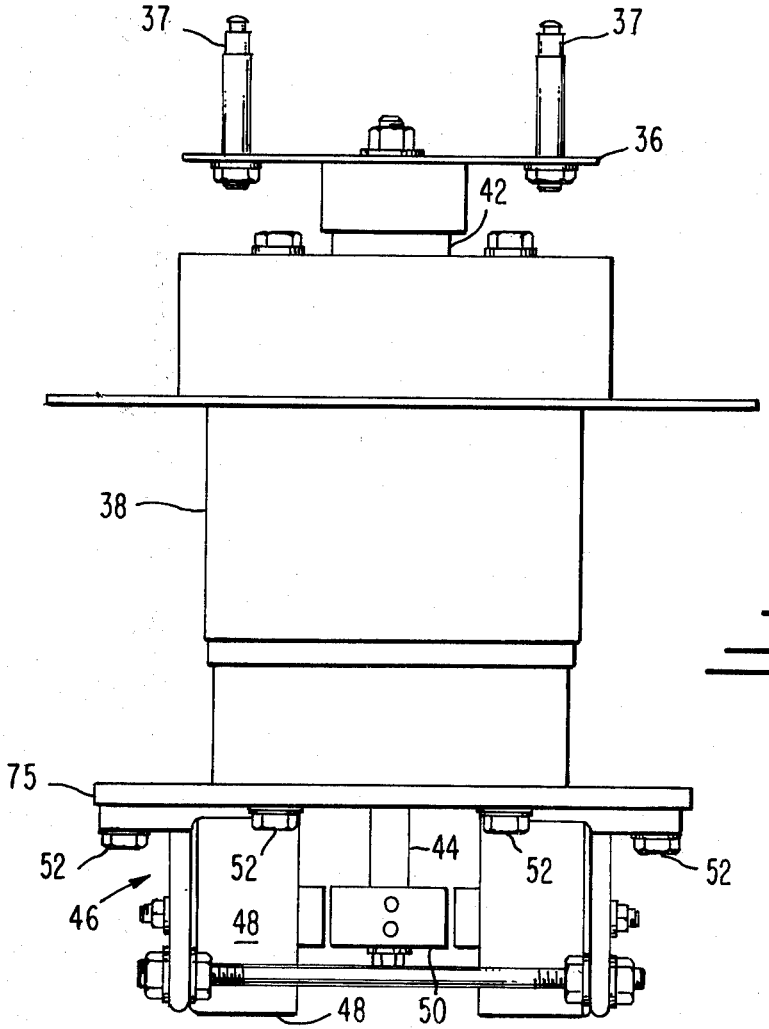
FIG. 3 is an end view of the carriage and rotational control assembly of another embodiment of the present invention.
Figure 2:
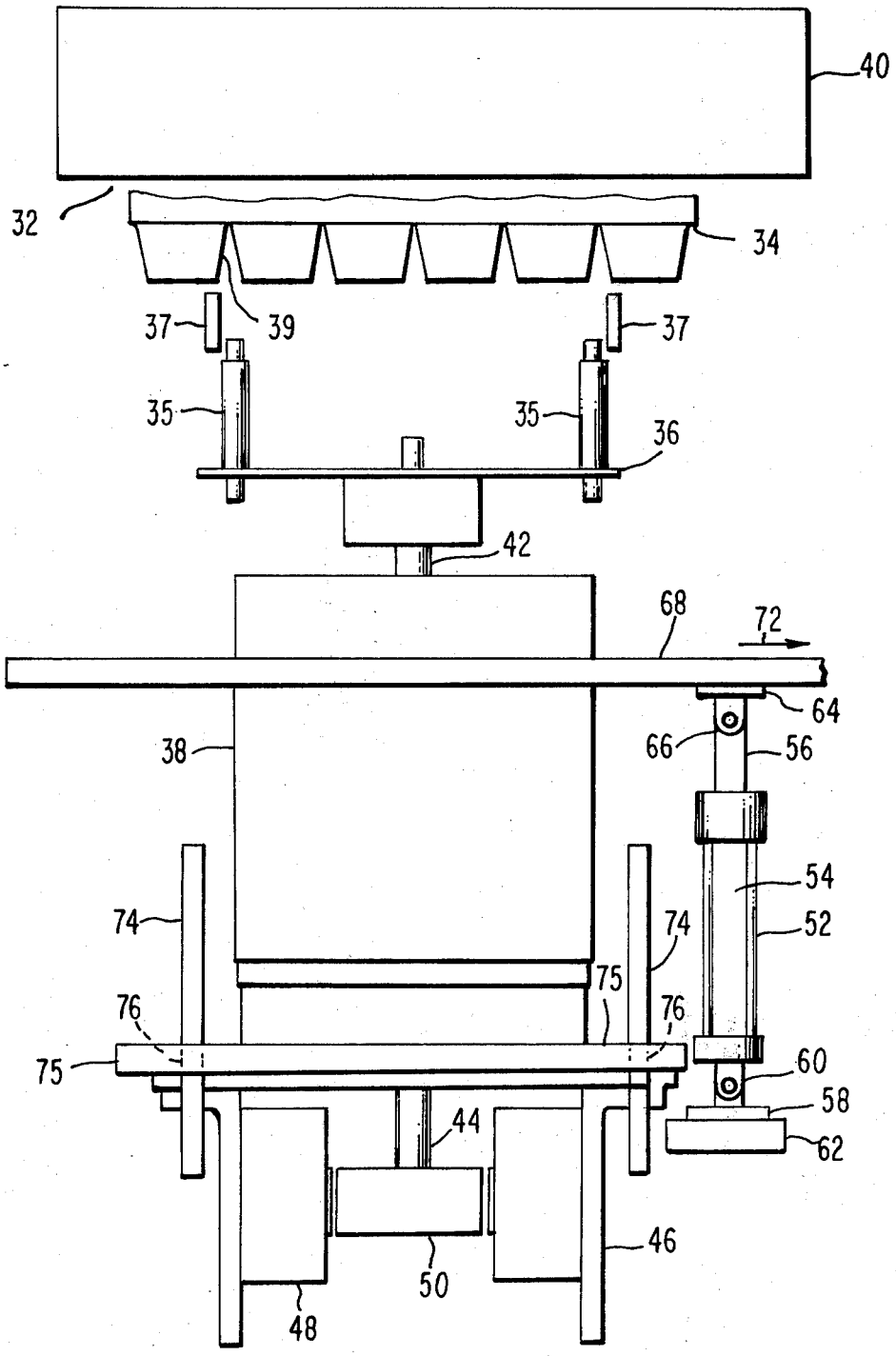
FIG. 2 is an end view of a portion of the embodiment of the present invention shown in FIG. 1.

The support member 36 is fixedly mounted to a shaft 42 which is rotatably mounted within body 38. In this embodiment the shaft 42 includes a lower section 44 which protrudes below the body 38 and is rigidly mounted on a rotational control means generally designated as 46. By means of shaft 42 this rotational control means achieves the desired rotational speed of tray support 36 as well as tray 34. The rotational control means can comprise a field member 48 and an armature member 50 to which shaft 42 and 44 are affixed. The distance between elements 48 and 50 can be chosen to be extremely small to thereby increase the electromagnetic forces therebetween. As shown in FIGS. 2 and 3, the electromagnetic rotational control means can be secured firmly to the body by conveniently available fastening devices such as bolts 52. In this configuration the rotational control means 46 will travel upwardly with the entire carriage assembly when the egg tray 34 is being lifted up into hood 40.

At full vertical extension the shaft 42 and support 36 will be caused to initiate rotation. The control means 46 causes braking of the rotational velocity of the carriage and then proper orientation and alignment when this velocity is zero. Then the carriage starts to move downward and the tray 34 is returned to the drying zone 32.

Vertical movement of the carriage and rotational control means is effected by a vertical moving means, generally designated as 52, which preferably is a pneumatically powered device having an air cylinder 54 which houses an air piston rod 56. The cylinder 54 may be secured to a bottom flange 58 through a coupling 60. The flange 58 is firmly mounted upon a stationary chasis element 62. Piston rod 56 is connected to a top flange 64 through a coupling 66. Flange 64 is secured to a shoulder 68 of body 38 such that as piston rod 56 is pneumatically extended, the entire carriage and rotational control assembly will be urged upwardly.

In a typical structure, the vertical moving means 52 will be positioned in the center of the drying station 28 as shown in dotted outline 70 of FIG. 1. Therefor, the shoulder 68 will form a fixed brace between two such bodies 38, which are individually associated with one or two lines of trays 24 which are passing to spin station 28. Thus, the vertical moving means is positioned equidistant between each of the two identical carriage assemblies. To further clarify the view in FIG. 2, it should be appreciated that the shoulder 68 will extend to the right as shown by the arrow 72 and form the shoulder element of another identical carriage assembly, rotational control assembly, and chute and hood structure.

To maintain stability in the orientation of the carriage with respect to the area 32 and hood 40 during vertical movement, a plurality of guides in the form of vertically extending pins 74 are provided which protrude through apertures 76 in the support plate 75. As the carriage is moved in the vertical direction, the body is guided by the pins 74 such that lateral wobble is prevented during extension and retraction of the piston rod 56. It must be expected that some degree of lateral wobble will occur in any piece of mechanical apparatus as large as present in this invention and therefor the couplings 60 and 66 in the pneumatic cylinder linkage can be chosen to be flexible connections such as hinges or even universal joints.

In a typical embodiment the conveyor 20 will carry the trays 34 through the drying zone 32 by entering immediately adjacent to the wash station 26 and exiting out the opposite side of the spin dryer generally designated as 28 to the stackers 30. The conveyor may be moved in cyclical manner such that the conveyor movement is halted when a tray is placed directly above the carriage in the pickup position in zone 32. In the halted position the arrangement of the washer 26 is positioned such that a washing operation can take place upon a tray positioned within the washer during operation of the spin drying process on another tray.

During operation an empty egg tray will enter the zone 32 and be advanced to a position directly above the carriage and then halted by the conveyor. As soon as the conveyor stops moving the pneumatic cylinder 54 will be actuated to urge piston rod 56 upward. In response thereto the body 38 will move vertically and carry therewith the control means 46 and the carriage as shown in FIG. 2 as well as another identical assembly which is mounted to the shoulder 68 at the position indicated by arrow 72. During the upward movement cycle, the studs 35 will contact the bottom surface of tray 34 and lift it off the conveyor. This complete assembly will proceed to the fully extended vertical position in which the tray 34 will be located within hood 40. At this time, the motor or rotational control means will be activated to cause rotation of shaft 42 and consequently support 36 and tray 34.

The configuration of the mating sections of the under surface of the trays and the configuration of the studs 35 are preferably related such that during the spinning operation, the tray will remain positioned on the support. In this respect, studs 35 should be oriented to protrude into the identations 39 which are present in the bottoms of standard egg trays.

The spinning operation usually takes merely a few seconds to reach the desired maximum speed which is on the order of 1750 revolutions per minute. In order to decrease the cycle time per operation, the rotational control means can be adapted to act as a electromagnetic braking means to increase the rate of deceleration of the rotating element. Also, each time the shaft is about to stop, the field elements 48 can repeatedly place armature 50 in the same relative alignment as it was when the tray was picked up and thereby the tray 34 will be replaced into the drying zone 32 in the same orientation as shown when it was picked up.

When the rotational speed of the shaft 42 stops, the cylinder 54 allows piston rod 56 to collapse downward until the tray 34 is replaced onto the conveyor 37 in the same orientation (exactly the same or 180° out of the rotation which achieves the same relative position) due to the orientation capability of rotational control means 46. The return of the tray to its exact previous position is further assured by the apertures 76 which slide up and down on the pins 74 and thereby maintain the vertical orientation of the vertically reciprocating assembly. After depositing the tray upon the conveyor 20 in the chute 32, this assembly proceeds downwardly to the bottom position to a point where the piston rod 56 has fully collapsed within the cylinder 54. Now the dryer is in the position preparatory to initiating another cycle.

While particular embodiments of this invention have been shown in the drawings and described above, it will be apparent, that many changes may be made in the form, arrangement and positioning of the various elements of the combination. In consideration thereof it should be understood that the preferred embodiments of this invention disclosed herein are intended to be illustrative only and not intended to limit the scope of the invention.

I claim:

1. For use with a conveying system or other similar transferring device, an apparatus for drying articles comprising:

a. a drying zone for receiving at least one wet article to be dried traveling along a conveyor system;

b. a vertically and rotatably movable carriage assembly positioned below said drying zone and adapted to move upwardly to lift and move the article above the conveyor;

c. a rotational control means secured to said carriage assembly and adapted to cause rotation of said carriage assembly and to increase the rotational velocity of said carriage assembly to expel liquid from the article to be dried, said rotational control means also adapted to decrease rotational velocity and stop rotation of said carriage assembly to allow replacing of the article on the conveyor; and d. a vertical moving means for selectively causing said carriage to move into contact with the underside of the article located in said drying zone on the conveyor and vertically move the article to a position above the conveyor.

2. The assembly as defined in claim 1 wherein said carriage assembly includes:

a. a body;

b. a shaft means rotatably mounted within said body and fixedly mounted to said rotational control means; and c. an article support member fixedly mounted to the upper end of said shaft means for contacting and liftng the article when said carriage assembly is urged upwardly by said vertical moving means.

3. The assembly as defined in claim 1 wherein said carriage assembly includes vertically projecting stud members which, in response to vertical movement, will contact and lift the article above the conveyor to facilitate spinning thereof.

4. The assembly as defined in claim 1 further comprising a hood member positioned above said drying zone to receive and extend around the article when lifted by said carriage and thus collect liquids which spin therefrom.

5. The assembly as defined in claim 1 wherein said rotational control means is electromagnetic.

6. The assembly as defined in claim 1 wherein said rotational control means includes:

a. an armature fixedly attached to said carriage assembly, and b. an electromagnetic field device positioned about said armature.

7. The assembly as defined in claim 1 wherein said rotational control means includes an electromagnetic orientation means facilitating alignment of the article when replaced by said carriage assembly into said drying zone.

8. The assembly as defined in claim 1 wherein said vertical moving means is pneumatically powered.

* * * * *